United States Patent [19]

Lampley

[11] Patent Number: 4,608,939

[45] Date of Patent: Sep. 2, 1986

[54] QUILTING OR SEWING GUIDE

[76] Inventor: Nancy Lampley, Rte. 2, Bon Aqua, Tenn. 37023

[21] Appl. No.: 750,285

[22] Filed: Jul. 1, 1985

[51] Int. Cl.[4] ..... D05B 91/10; D05C 9/04

[52] U.S. Cl. ..... 112/260; 112/266.1; 434/95; 434/112; 33/562; 2/243 B

[58] Field of Search ..... 112/266.1, 260, 136, 112/65, 439, 103, 119; 434/95, 96, 112, 117; 33/562, , 13, 12; 28/151, 152; 38/102.1, 102.91; 2/243 B

[56] References Cited

U.S. PATENT DOCUMENTS

| | | | |
|---|---|---|---|
| 455,338 | 7/1891 | Kelley | 33/13 |
| 532,110 | 1/1895 | Stockmann | 434/95 |
| 1,552,672 | 9/1925 | Bernando | 33/13 |
| 2,077,772 | 4/1937 | Ring | 33/13 |
| 2,574,064 | 11/1951 | Rosen | 434/95 |
| 2,585,946 | 2/1952 | Liberman | 434/95 |
| 3,134,173 | 5/1964 | Williams | 33/13 X |
| 3,732,638 | 5/1973 | Hanley | 38/102.91 |
| 3,749,038 | 7/1973 | Dodsworth | 112/136 X |
| 3,794,554 | 2/1974 | Caring | 2/243 B X |

FOREIGN PATENT DOCUMENTS

| | | | |
|---|---|---|---|
| 131121 | 2/1901 | Fed. Rep. of Germany | 33/12 |

*Primary Examiner*—Werner H. Schroeder
*Assistant Examiner*—Andrew M. Falik
*Attorney, Agent, or Firm*—Pitts and Brittian

[57] ABSTRACT

A pattern or template for achieving controlled hand sewing. The pattern or template (10) is fabricated using two complementary template units (12, 14) that can be superimposed upon each other to enclose a fabric (40) therebetween. Releasable attaching means (24, 26, 32, 34) provide for releasably joining the unit to the fabric. Each of the template units is provided with a plurality of perforations (16, 20) along a selected path (18, 46) with these perforations in one of the template units sufficiently overlapping the perforations in the other template unit whereby a needle (38) with a thread (42) attached can be passed through the template units to achieve selected stitches in the fabric. The template units can be provided, in one embodiment, with raised indicia (36) corresponding to braille-type markings so that the unit can be used by persons with visual handicaps. If desired, contrasting colors can be utilized between the template units themselves and the interior of the perforations to reduce eye strain, and the surfaces of the template units can be finished in a matte finish to also reduce this eye strain.

6 Claims, 3 Drawing Figures

QUILTING OR SEWING GUIDE

DESCRIPTION

1. Technical Field

This invention relates generally to guides or templates, and more specifically to a guide or template to be used for sewing, quilting, or the like, to achieve a selected sewn pattern by hand sewing. One embodiment of the invention permits such sewing or quilting by a person with a visual handicap.

2. Background Art

Although a large proportion of sewing that is currently performed both commercially and in the home is through the use of a sewing machine, there are still numerous applications where hand sewing is preferred. For example, many seamstresses perfer to do heming with a hand stitch, rather than with a machine. Furthermore, considerable quilting is performed by hand, as well as the sewing of appliques to a background cloth. These types of hand sewing are extremely tedious when efforts are made to make the individual stitches match adjoining stitches. Furthermore, it is nearly always necessary, unless a straight line is to be sewn, to mark the particular line where sewing is to be achieved so that this line can be followed during this sewing operation. This is particularly true where specific patterns are to be quilted into an overall design. The guide line is either covered with the stitches or must be removed as by washing the finished article. In addition, hand sewing is virtually impossible for persons with visual handicaps. Those with some sight can use a magnifying glass, for example, but those with very limited or no sight are precluded from hand sewing in general.

A template or pattern for use in the basting of seams for garments is disclosed in U.S. Pat. No. 2,077,772, issued to E. R. Ring on Apr. 20, 1937. The essential feature of the pattern of that patent is that it is formed having two layers, one folded with respect to the other, with each layer having alternating juxtoposed series of slots or other perforations. It is designed for placement at or near the edge of pieces of fabric whereby a needle attached to thread can be passed through these perforations, and thereafter the pattern can be removed. The stitches thus formed serve as basting stitches which are ultimately removed following the normal sewing of the garment along such edges of the fabric. There is no suggestion as to how the particular construction of the patent can be used for other than the sewing of a basting line for garments.

Accordingly, it is a principle object of the present invention to provide a pattern or template which can be releasably placed upon any portion of fabric for the hand sewing of stitches along a selected pattern on such fabric.

It is a further object of the present invention to provide a pattern or template having two separate components, one to be selectively placed on either side of a piece of fabric, with releasable fasteners joining the two components, and with perforations of selected size and shape which cooperate permitting the sewing of the particular stitch along the particular pattern.

It is a further object of the present invention to provide a pattern or template which will allow visually handicapped persons to perform hand sewing along a selected path or pattern on a piece of fabric.

These and additional objects of the present invention will become more apparent upon the consideration of the detailed description which follows when taken together with the attached drawings.

DISCLOSURE OF THE INVENTION

In accordance with the present invention, there are provided two complimentary template units; one for releasably securing to each side of a sheet or sheets of fabric for the generation of hand sewn stitches of a selected size along a selected path or route. Provision is made to releasably join the two template units to the fabric at a selected point such that a needle and thread passed through perforations in the two template units produces stitches in the fabric without becoming engaged with the template units. The perforations in the templates are arranged to achieve the selected path or pattern of the stitches, with the size of the perforations providing the selected stitch length. In this manner, duplicate hand stitching can be accomplished over various portions of the fabric. In one embodiment of the invention, braille-type indicia are applied to the exposed surface of the template units such that a person with a visual handicap can follow the route of the perforations and perform such sewing along a preselected path.

BEST MODE FOR CARRYING OUT THE INVENTION

Figure 1:
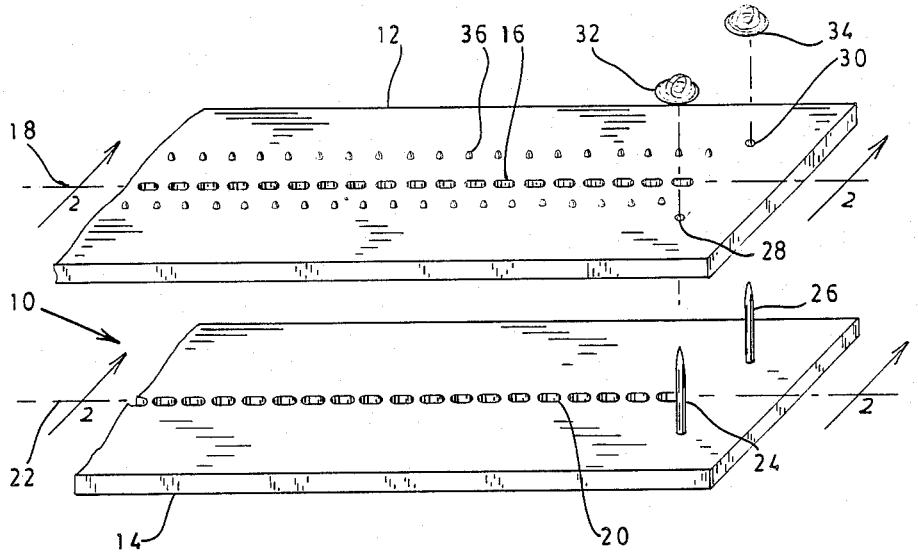
FIG. 1 is a fragmentary and exploded view of the two template units of the present invention.

One embodiment of the guide of the present invention is shown generally at 10 in FIG. 1. This particular embodiment is useful in the preparation of uniform stitches in a straight line such as those that may be required for the hemming of a fabric article. The guide has a pair of complimentary patterns or templates 12, 14 with template 12 having a plurality of perforations 16 aligned, for example, along a centerline 18. Template 14 is also provided with a plurality of perforations 20 aligned along, for example, centerline 22. The positioning of the perforations 16 and 20 are such that a perforation 16 substantially overlaps a space between the perforations 20. This arrangement of the perforations 16, 20 will be more clearly understood with reference to FIG. 2.

Also shown in FIG. 1 is one embodiment for releasably holding the templates 12, 14 at a selected position on a piece of fabric (not shown). In this particular embodiment, a pair of upright pointed projections 24, 26 extend from the template 14 to be received in corresponding apertures 28, 30 in template 12. Releasable fasteners 32, 34 are provided to grasp the surface of the projections 24, 26 whereby the templates 12 and 14 are releasably joined. It will be understood that a corresponding pair of sharpened projections would be utilized at the opposite end of the templates 12, 14. Although two projections are shown at the end of the templates, a singular unit could be used if desired. Also, it will be understood that other types of releasable fastening units can be used if such fasteners produce no permanent damage to the fabric.

One of the objects of the present invention is to make the invention usable by persons having limited or no eyesight. Shown in FIG. 1 are braille-like projections 36 on the exposed surface of template 12. It will be understood that similar projections would be provided on the exposed surface of template 14 as well. These projections can be singular as shown or can be in any desired arrangement to give proper orientation by feel of a user of the present invention. They can be, for example, positioned as shown or can be positioned between perforations. Other types of indicia can be placed adjacent the perforations.

Figure 2:
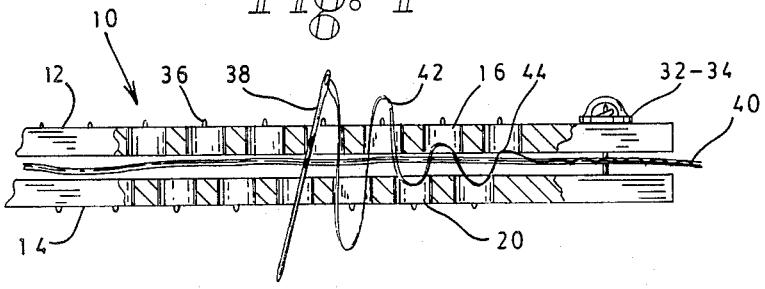
FIG. 2 is a cross-sectional view of the template units of FIG. 1, taken at 2—2 therein, showing the template units applied to a piece of fabric.

A cross-sectional view of the present invention of FIG. 1 is shown in FIG. 2. In this figure, the off-set relationship of perforations 16, 20 is more clearly illustrated. It can be seen, for example, that a needle 38 can pass through a farther end (with respect to the fasteners 34) of a perforation 16 and thence through fabric 40 and through the closer end of an perforation 20, causing a thread 42 to create stitches 44 that do not interlock with the template components 12 and 14. It can be seen that the length of the stitch can be adjusted by the length of the perforations 16 and 20, and even the length of the stitches on the opposite side of a fabric 40 can be varied by having differing lengths of perforations 16 from perforations 20. After all of the stitches have been made in the fabric 40, the fasteners 34 (and 32 of FIG. 1) are removed and the two portions 12, 14 are separated and removed from fabric 40, leaving the stitches 44 in the preselected pattern on the fabric.

Figure 3:
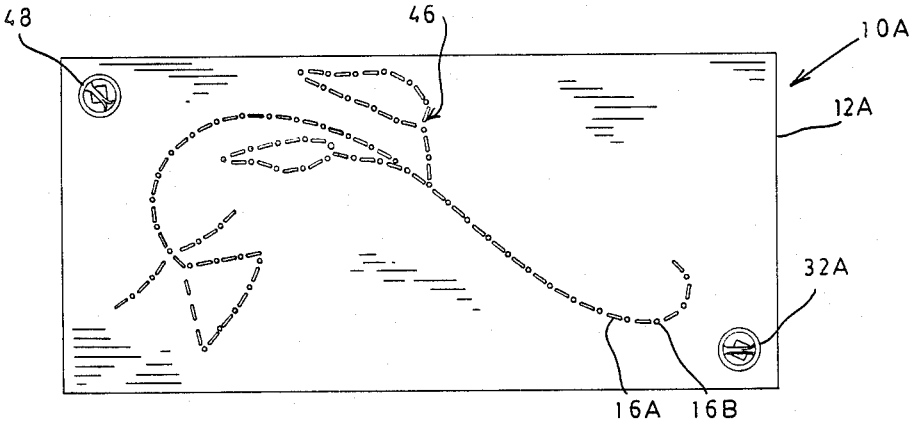
FIG. 3 is a top view of a template unit showing the use of various perforations sizes as applied to the sewing of a preselected path or pattern.

The embodiment illustrated in FIGS. 1 and 2 is designed for the sewing of a straight row of stitches in the fabric. There are instances where it is desired to sew stitches in a preselected pattern other than a straight row, and have each of the patterns sewn such that they are substantially identical. An embodiment of the present invention for this use is shown generally at 10A in FIG. 3. This is a top view of template 12A, having perforations 16A and 16B laid out in a particular pattern or design 46. In this particular embodiment, a further variation is illustrated in the form of stitches having two different lengths as defined by apertures 16A and 16B. It will be understood that the other template (not shown) for the opposite side of the fabric would have apertures corresponding to those shown, but providing an overlap whereby the stitching as illustrated in FIG. 2 can be accomplished. This particular embodiment shows a singular fastener 32 at one end and a singular fastener 48 at the second end of the template. With this type of template, a plurality of identical stitchings can be accomplished such as might be desired in the fabrication of a quilt pattern or the like. Although not indicated, this embodiment can also be provided with braille-type raised portions whereby a sight handicapped person can utilize this device.

Typically, the present invention would be fabricated of a light weight but relatively durable material. Typically, this would be a plastic, and can be either transparent or opaque. If transparent templates are utilized, the layout of the templates upon a fabric to match additional patterns is simplified. It will be understood that other durable materials can be utilized for the fabrication of this device. If it is desired to minimize glare on the templates, the exposed surfaces can be provided with a matte finish in order to reduce eye fatigue. Also, the interior of the perforations can be made a contrasting color to further facilitate the location of the perforations.

From the foregoing, it will be apparent to one versed in the art that a very useful sewing guide or template has been provided for use in achieving uniform, as well as varying, stitch lengths along a preselected path. This device is useful by both fully sighted persons as well as those with visual handicaps. Although only specific embodiments of the present invention are shown and described herein, the invention is not intended to be limited by those embodiments; rather the scope of the invention is to be defined by these descriptions taken together with the attached claims and their equivalents.

I claim:

1. A reusable sewing pattern for achieving hand sewn stitches of a selected controlled length along a selected path at any position in a fabric, which comprises:

a first substantially rigid template unit fabricated of a durable material to be placed on one surface of such fabric, said first template unit provided with a plurality of perforations therethrough to receive and guide a needle and thread to produce such stitches, said perforations being of a dimension to produce such selected length and arranged along such selected path;

a second substantially rigid template unit fabricated of a durable material to be placed on an opposite surface of such fabric, said second template unit provided with a plurality of perforations therethrough to receive and guide said needle and thread, said perforations in said second template unit being complimentary to and overlapping spaces between perforations in said first template unit an amount just sufficient for passage of said needle and thread to produce stitches of such selected length arranged along such selected path; and fastener means for releasably attaching said first and second template units to such fabric and for accurately aligning said perforations of said first and second template units in said overlapping relationship during the forming of such hand sewn stitches by said needle and thread, said fastener means comprising at least two stud members attached to and extending from one of said template units, the other of said template units provided with apertures for the passage of said stud members therethrough, whereby said overlapping relationship of said perforations in said first and second template units provides for closely receiving said needle and thread at each ends of said perforations and thereby produces such stitches of such controlled length such selected path.

2. The sewing pattern of claim 1 wherein said stud members comprise sharpened upright projections on said one of said template units, said projections being of sufficient length to penetrate and extend from said other template unit, and clasp means for grasping said extensions of said projections external to said other template unit.

3. The sewing pattern of claim 1 further comprising braille-type dots proximate each of said perforations in said first and second template units to facilitate use of such pattern by a visually handicapped person.

4. The sewing patern of claim 1 wherein the interior surface of said perforations of said first and second template units is of a contrasting color to the color of the remainder of said template units to make said perforations visible during such achieving of such stitches using said needle and thread.

5. The sewing pattern of claim 1 wherein said perforations in said first and second unit vary in length but are of substantially equal width, to produce stitches of varying lengths corresponding to said lengths of said perforations.

6. The sewing pattern of claim 1 wherein said perforations in said first and second template units are arranged along a line designating a design whereby said design can be duplicated in stitches wherever such pattern is applied to such fabric.

* * * * *